US006341913B1

(12) United States Patent
Wilson-Jackson

(10) Patent No.: US 6,341,913 B1
(45) Date of Patent: Jan. 29, 2002

(54) MASCARA BRUSH AND STORAGE CONTAINER THEREFOR

(76) Inventor: Celeste S. Wilson-Jackson, 107 W. Hillside Ave., Barrington, IL (US) 60010

( * ) Notice: Subject to any disclaimer, the term of this patent is extended or adjusted under 35 U.S.C. 154(b) by 0 days.

(21) Appl. No.: 09/757,359

(22) Filed: Jan. 9, 2001

(51) Int. Cl.[7] ..... A46B 11/00
(52) U.S. Cl. ..... 401/129; 401/126; 15/207.2
(58) Field of Search ..... 401/126, 129, 401/118, 119, 121, 122; 15/207, 206, 207.2

(56) References Cited

U.S. PATENT DOCUMENTS

| | | | | |
|---|---|---|---|---|
| 2,691,184 A | | 10/1954 | Miller et al. | |
| 2,710,614 A | | 6/1955 | Dulberg | |
| 3,181,539 A | | 5/1965 | Aston | |
| 3,690,777 A | | 9/1972 | Costa | |
| 4,165,755 A | | 8/1979 | Cassai | |
| 4,600,328 A | | 7/1986 | Clements | |
| 4,886,080 A | | 12/1989 | Cole | |
| 4,972,858 A | | 11/1990 | Beck et al. | |
| 4,993,858 A | | 2/1991 | Mock | |
| 5,052,839 A | | 10/1991 | Pettengill | |
| 5,056,179 A | | 10/1991 | Capponi | |
| 5,137,038 A | | 8/1992 | Kingsford | |
| 5,176,754 A | | 1/1993 | Hirzel | |
| 5,319,823 A | * | 6/1994 | Baum et al. | 15/206 |
| 5,542,439 A | * | 8/1996 | Gueret | 15/207.2 |
| 5,595,198 A | * | 1/1997 | Kemmerer | 401/129 |
| 5,611,361 A | | 3/1997 | Leone | |
| 5,860,432 A | | 1/1999 | Gueret | |
| 5,941,254 A | | 8/1999 | Heler | |
| D429,847 S | | 8/2000 | Lang | |
| 6,120,202 A | | 9/2000 | Donsky | |

* cited by examiner

*Primary Examiner*—David J. Walczak
(74) *Attorney, Agent, or Firm*—Charles F. Meroni, Jr.; Meroni & Meroni, P.C.

(57) ABSTRACT

An improved mascara brush for applying mascara to eyelashes comprises a handle, a shaft extending from the handle having a first and second portion, the length of the first and second portions of the shaft having sufficient combined length to simultaneously reach all of the eyelashes of the eye, a first row of bristles connected to the shaft in a continuous clockwise spiral of decreasing length about the first portion of the shaft, and a second row of bristles connected to the shaft in a continuous clockwise spiral of decreasing length about the second portion of the shaft. A cylindrical storage container for containing an amount of mascara and accepting a mascara brush of sufficient length to simultaneously reach substantially all of the eyelashes of an eye stores the improved mascara brush.

8 Claims, 2 Drawing Sheets

MASCARA BRUSH AND STORAGE CONTAINER THEREFOR

BACKGROUND OF THE INVENTION

1. Field of the Invention

The claimed invention relates to an improved brush for applying cosmetic products and a storage container therefor, in particular an improved brush for applying mascara to the eyelashes and a storage container to store the improved brush and an amount of mascara for application to the eyelashes.

2. Description of the Prior Art

The use of brushes to apply mascara to the eyelashes is well known in the prior art. Various types of brushes have been employed to accomplish this task with the most common designs either changing the configuration of the brush shaft or changing the bristle profile to achieve different results.

Some examples of mascara brushes having varying designs are U.S. Pat. Nos. 4,165,755, 4,600,328, 5,860,432, and 5,941,254. U.S. Pat. No. 4,165,755 issued to Cassai discloses an adjustable mascara wand with a straight shaft extension having a cone shaped bristle profile that is pivotally secured to a main shaft to allow the shaft extension to pivot so that the user can adjust the brush for differing applications. This brush has two major problems when applying mascara to the eyelashes. First, the width of the combined bristle rows does not enable the user to cover the entire eyelash width with one stroke, thus making it necessary to perform several strokes. Second, the configuration of the bristle profile makes it necessary for the user to angle the brush in order to reach the interior and exterior portions of the eyelashes.

U.S. Pat. No. 4,600,328 issued to Clements discloses a mascara applicator with two brushes having bristles configured as oppositely oriented cones. The oppositely oriented cones provide different bristle profiles for the right and left eyes, however these brushes still produce the same problems as previously mentioned.

U.S. Pat. No. 5,860,432 issued to Gueret discloses a brush having a straight or curved stem and a bristle profile defined by two peak lines having a specific curvature. The curvature of the bristle profile helps the user to reach the interior and exterior portions of the eyelashes, but the width of the combined bristle rows does not enable the user to cover the entire eyelash width with one stroke, thus making it necessary to perform several stokes. Second, the placement of the bristles on the shaft requires the user to rotate their wrist in order to apply the mascara effectively to the opposite eye thus making it awkward for the user.

U.S. Pat. No. 5,941,254 issued to Heler discloses a mascara brush having a straight shaft and a spiral configuration of bristles that is capable of mounting an eye liner pencil in the handle of the mascara brush. While the spiral configuration provides effective means for transferring the mascara from the bristles to the eyelashes, the user is still faced with the same problems previously mentioned.

While these brushes produce satisfactory results when applying mascara to a person's eyelashes, there still remains a need for a mascara brush that can be used to apply mascara to the eyelashes of both eyes that cover the entire width of the eyelashes without need to rotate the wrist or angle the brush to reach the interior and exterior regions of the eyelashes.

SUMMARY OF THE INVENTION

Accordingly, it is the object of the claimed invention to provide an improved mascara brush and storage container therefor by providing a mascara brush that allows a person to apply mascara to substantially all of the eyelashes of an eye without having to angle the brush to reach the smaller eyelashes at the interior or exterior portion of the eye.

Another objector of the claimed invention is to provide an improved mascara brush and storage container therefor that allows the user to apply mascara to the eye opposite the hand being used to hold the mascara brush without having to rotate the wrist in order to apply mascara.

This is accomplished by providing an improved mascara storage and application device for applying mascara to eyelashes comprising a cylindrical storage container capable of containing an amount of mascara and accepting a mascara brush of sufficient length to simultaneously reach substantially all of the eyelashes of an eye, the cylindrical storage container comprising a substantially flat bottom surface, a top surface having a threaded neck portion with an aperture therethrough, the aperture sized and shaped to wipe excess mascara from a mascara brush when removing the mascara brush from the cylindrical container, waisted exterior side surfaces for gripping the cylindrical storage container, a mascara brush for applying mascara to the eyelashes, the mascara brush comprising, a handle having a first and second end configured for right and left handed users, the second end of the handle having a circular recessed portion with a wall section and a floor section, the wall section having a set of threads extending therefrom being complementary to the threads of the threaded neck portion, a shaft having a first end inserted into the handle and a second end, the shaft extending from the second end of the handle having a first portion adjacent the handle and a second portion juxtaposed the first portion, the length of the first portion and second portion of the shaft having sufficient combined length to simultaneously reach substantially all of the eyelashes of the eye, a first row of bristles connected to the shaft beginning adjacent the handle and extending substantially perpendicular from the shaft in a continuous clockwise spiral of decreasing length about the first portion of the shaft and terminating at the second portion of the shaft, a second row of bristles connected to the shaft beginning at the second end of the shaft and extending substantially perpendicular from the shaft in a continuous clockwise spiral of decreasing length about the second portion of the shaft and terminating at the first portion of the shaft so that a person can apply a substantially even amount of mascara across substantially all of the eyelashes of both eyes using one hand.

DETAILED DESCRIPTION OF THE PREFERRED EMBODIMENT

Figure 1:
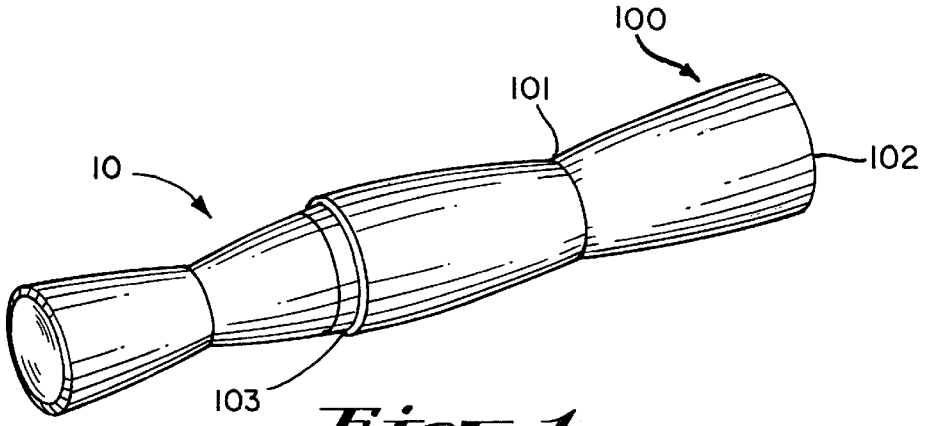
FIG. 1 is a perspective view of the improved mascara storage and application device.

Referring now to the drawings, an improved mascara brush 10 and storage container therefor 100 are illustrated in FIGS. 1 through 4.

FIG. 1 shows a perspective view of the mascara brush 10 stored in the storage container 100. The storage container 100 has waisted exterior side surfaces 101 to allow the user to grip the storage container 100 while inserting or removing the mascara brush 10 from the storage container 100. The storage container 100 is of sufficient size to store the mascara brush 10 and an amount of mascara 90.

Figure 2:
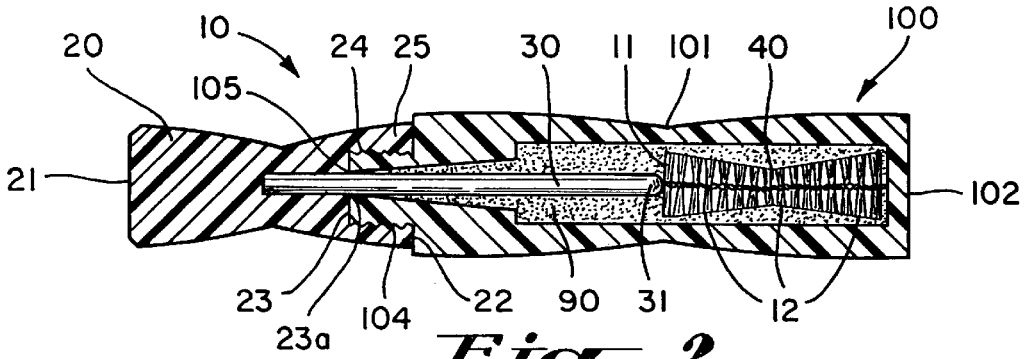
FIG. 2 is a sectional view of the improved mascara storage and application device.

FIG. 2 shows a side sectional view of the mascara brush 10 and mascara 90 stored in the storage container 100. The storage container 100, has a substantially flat bottom surface 102 and a top surface 103 that has a threaded neck portion 104 with an aperture 105 through which the mascara brush 10 is inserted or removed from the storage container 100. The size of the aperture 105 is smaller than the outer diameter 11 of the bristles 12 of the mascara brush 10 so that the aperture 105 performs a wiping action against the bristles 12 of the mascara brush 10 when removing the mascara brush 10 from the storage container 100 to remove excess mascara from the bristles 12.

The mascara brush 10 has a handle 20 that is adapted for right and left handed users with a first end 21 and a second end 22. A circular recess 23 within the second end 22 of the handle 20 having a floor section 23A and a set of female threads 24 in the walls 25 of the circular recess 23 is sized to accept the threaded neck portion 104 of the storage container 100.

The stem 30 of the mascara brush 10 is inserted into the second end 22 of the handle 20 and extends from the handle 20 to a length 31 that will allow the shaft 40 to reach the bottom of the storage container 100.

Figure 3:
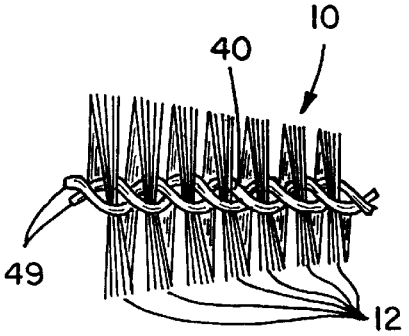
FIG. 3 is an enlarged partial plan view of the improved mascara brush.
Figure 4:
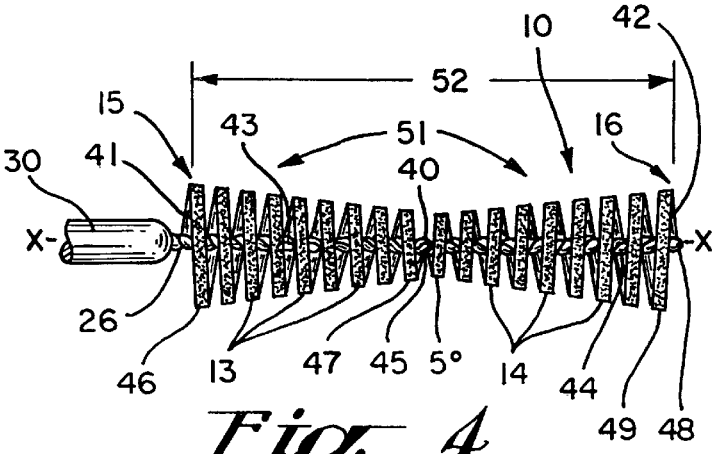
FIG. 4 is a plan view of the improved mascara brush.

Referring to FIG. 3, the shaft 40 is made of twisted wire 49 molded into the stem 30 with the bristles 12 passing between the twisted wire 49. For explanatory purposes, the shaft 40 and the spiraling bristle row configurations 41 and 42 are split into a first portion 43 and second portion 44 as shown in FIG. 4 at the center point of the shaft 45. The bristles 13 that are connected to the shaft 40 on the first portion 43 of the shaft 40 are connected to the shaft 40 in a clockwise spiraling bristle row configuration 41 about the shaft 40 when looking down the long axis X—X of the shaft 40 from the handle end 26. The length of the bristles 12 connected to the first portion 43 of the shaft 40 decrease from a beginning length 46 near the handle 20 to a terminating length 47 near the center point 45 of the shaft 40.

The bristles 12 that are connected to the shaft 40 on the second portion 44 of the shaft 40 are connected in a counter-clockwise spiraling bristle row configuration 42 about the shaft 40 when looking down the long axis X—X of the shaft 40 from the end of the mascara brush 48. The length of the bristles 14 connected to the second portion 44 of the shaft 40 decrease from a beginning length 49 near the end of the mascara brush 48 to a terminating length 50 near the center point of the shaft 45. The resulting bristle profile 51 of the mascara brush 10 provides bristles 13, and 14 in opposite spiraling directions 41 and 42 for use on both eyes 201 and 301.

Figure 5:
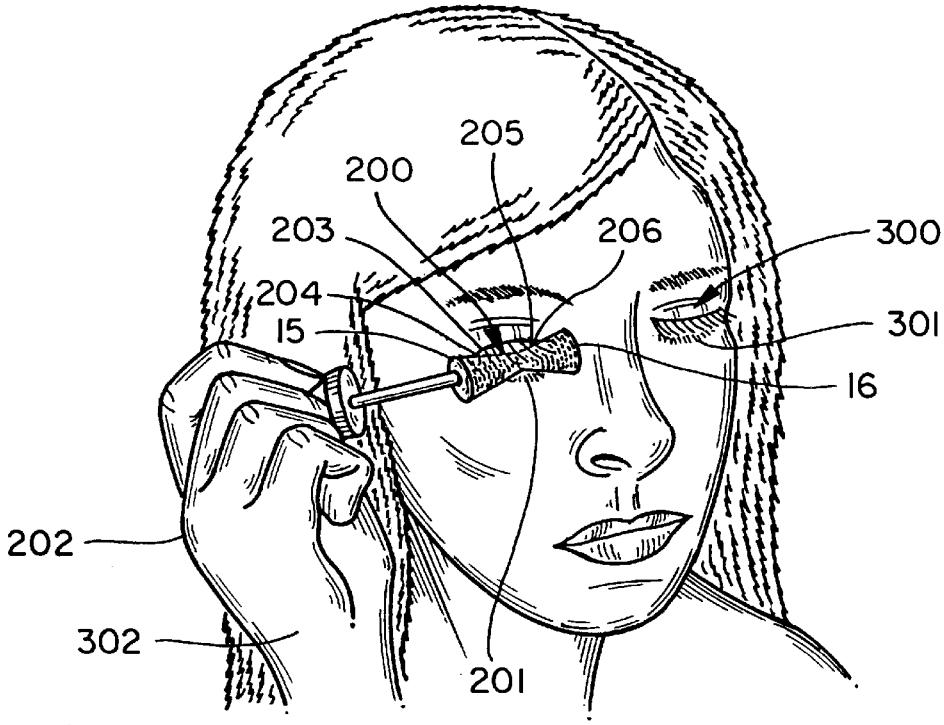
FIG. 5 is a perspective view of a right handed person using the improved mascara brush on the right eye.

FIG. 5 shows the spiral configuration 41 of the bristles 13 nearest the handle 20 facilitates transferal of mascara 90 from the mascara brush 10 to the eyelashes 203 near the exterior portion of the eye 204 by stroking the shorter eyelashes 203 in the direction that they grow from the eye 201. The spiral configuration 42 of the bristles 14 of the second portion 44 of the mascara brush 10 facilitates transferal of mascara 90 from the mascara brush 10 to the shorter eyelashes 205 near the interior portion of the eye 206 by stroking the shorter eyelashes 205 in the direction that they grow from the eye 201. The combined overall width 52 of the spiraling bristle rows 41 and 42 that cover the first portion 43 and the second portion 44 provides a bristle profile 51 that is wide enough to cover substantially all of the eyelashes 200 and 300 of one eye 201 or 301 simultaneously. In one embodiment, the combined width 52 of the spiraling bristle rows 41 and 42 is 1⅛", and in another embodiment, the combined width 52 is 1¼". However, varying widths 52 of spiraling bristle rows 41 and 42 are contemplated within this approximate range. The overall width 52 of the spiraling bristle rows 41 and 42 help the user to place an even amount of mascara 90 across the eyelashes 200 and 300 of an eye 201 or 301 by reducing the number of strokes necessary to obtain a desirable amount of mascara coverage.

FIG. 5 is a perspective view of a person using the mascara brush 10 with their right hand 202 to place mascara 90 on the eyelashes 200 of the right eye 201. The overall width 52 of the spiraling bristle rows 41 and 42 covers substantially all of the eyelashes 201 simultaneously. The longer bristles 15 connected to the first portion 43 of the shaft 40 near the handle 20 touch the shorter eyelashes 203 near the exterior portion of the eye 204. The longer bristles 16 connected to the second portion 44 of the shaft 40 near the end 48 of the mascara brush 10 touch the shorter eyelashes 205 near the interior portion of the eye 206.

Figure 6:
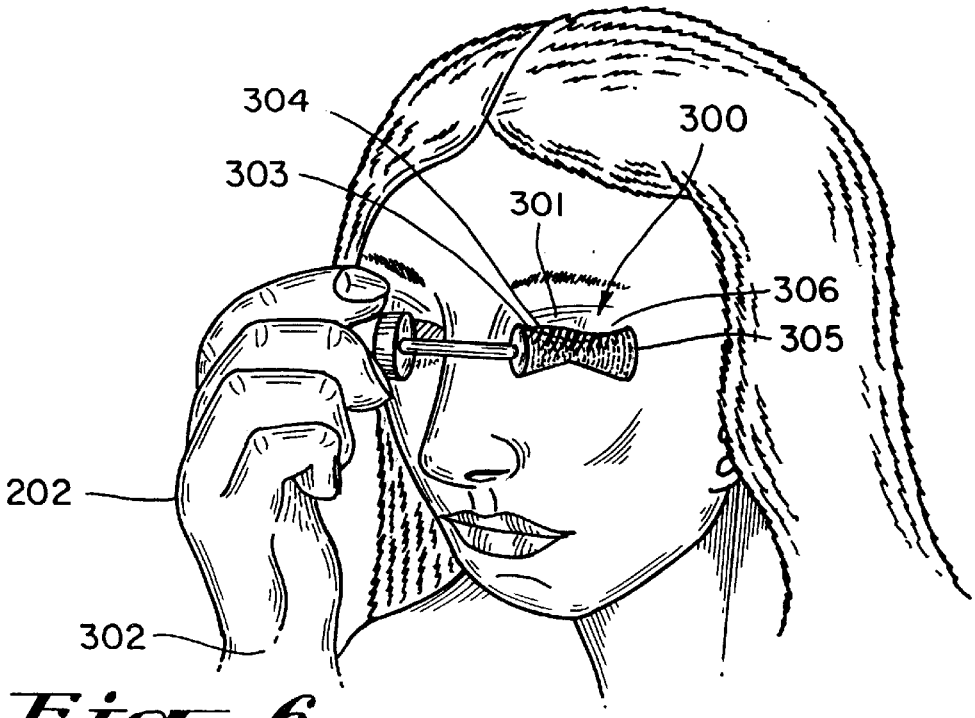
FIG. 6 is a perspective view of a right handed person using the improved mascara brush on the left eye.

FIG. 6 is a perspective view of a person using the mascara brush 10 with their right hand 202 to place mascara 90 on the eyelashes 300 of the left eye 301 without having to rotate the wrist 302 in order to properly apply mascara 90 to the eyelashes 300 of the left eye 301. The overall width 52 of the spiraling bristle rows 41 and 42 covers substantially all of the eyelashes 200 or 300 simultaneously. The longer bristles 15 connected to the first portion 43 of the shaft 40 near the handle 20 touch the shorter eyelashes 303 near the interior portion of the eye 304. The longer bristles 16 connected to the second portion 44 of the shaft 40 near the end 48 of the mascara brush 10 touch the shorter eyelashes 305 near the exterior portion of the eye 306.

I claim:

1. An improved mascara brush for applying mascara to eyelashes of both eyes, the improved mascara brush comprising:

a handle configured for right and left handed users;

a shaft having a first end inserted into the handle and a second end, the shaft extending from the handle having a first portion adjacent the handle and a second portion juxtaposed the first portion, the length of the first portion and the second portion of the shaft having sufficient combined length to simultaneously reach substantially all of the eyelashes of the eye;

a first row of bristles connected to the shaft beginning adjacent the handle and extending from the shaft in a continuous counter-clockwise spiral of decreasing length about the first portion of the shaft and terminating at the second portion of the shaft;

a second row of bristles connected to the shaft beginning at the second end of the shaft and extending from the shaft in a continuous clockwise spiral of decreasing length about the second portion of the shaft and terminating at the first portion of the shaft so that a person can apply a substantially even amount of mascara across substantially all of the eyelashes of both eyes using one hand.

2. The improved mascara brush of claim 1 wherein the first and second rows of bristles each have a conical shape and merge together at a common apex, the continuous spirals of the first and second rows of bristles spiraling in opposite directions relative to one another from the common apex.

3. The improved mascara brush of claim 2 wherein the first portion of the shaft and the second portion of the shaft have a combined length from about 1⅛" to about 1¼".

4. An improved mascara storage and application device for applying mascara to eyelashes of both eyes, the improved device comprising:

a cylindrical storage container capable of containing an amount of mascara and accepting a mascara brush of sufficient length to simultaneously reach substantially all of the eyelashes of an eye, the cylindrical storage container comprising:

a substantially flat bottom surface;

a top surface having a threaded neck portion with an aperture therethrough, the aperture sized and shaped to wipe excess mascara from a mascara brush when removing the mascara brush from the cylindrical container;

waisted exterior side surfaces for gripping the cylindrical storage container;

a mascara brush for applying mascara to the eyelashes, the mascara brush comprising:

a handle having a first and second end configured for right and left handed users, the second end of the handle having a circular recessed portion with a wall section and a floor section, the wall section having a set of threads extending therefrom being complementary to the threads of the threaded neck portion;

a shaft having a first end inserted into the handle and a second end, the shaft extending from the second end of the handle having a first portion adjacent the handle and a second portion juxtaposed the first portion, the length of the first portion and second portion of the shaft having sufficient combined length to simultaneously reach substantially all of the eyelashes of the eye;

a first row of bristles connected to the shaft beginning adjacent the handle and extending from the shaft in a continuous counter-clockwise spiral of decreasing length about the first portion of the shaft and terminating at the second portion of the shaft;

a second row of bristles connected to the shaft beginning at the second end of the shaft and extending from the shaft in a continuous clockwise spiral of decreasing length about the second portion of the shaft and terminating at the first portion of the shaft so that a person can apply a substantially even amount of mascara across substantially all of the eyelashes of both eyes using one hand.

5. The improved mascara storage and application device for applying mascara to eyelashes of claim 4 wherein the first and second rows of bristles each have a conical shape and merge together at a common apex, the continuous spirals of the first and second rows of bristles spiraling in opposite directions relative to one another from the common apex.

6. The improved mascara storage and application device for applying mascara to eyelashes of claim 5 wherein the first portion of the shaft and the second portion of the shaft have a combined length from about 1⅛" to about 1¼".

7. The improved mascara brush of claim 4 wherein the first and second rows of bristles extend substantially perpendicular from the shaft.

8. The improved mascara brush of claim 1 wherein the first and second rows of bristles extend substantially perpendicular from the shaft.

* * * * *